US006520633B2

(12) United States Patent
Nakamura

(10) Patent No.: US 6,520,633 B2
(45) Date of Patent: Feb. 18, 2003

(54) INK-JET RECORDING APPARATUS

(75) Inventor: Hirotake Nakamura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/928,375

(22) Filed: Aug. 14, 2001

(65) Prior Publication Data

US 2002/0027583 A1 Mar. 7, 2002

(30) Foreign Application Priority Data

Aug. 30, 2000 (JP) ..... 2000-260068

(51) Int. Cl.[7] ..... B41J 2/175
(52) U.S. Cl. ..... 347/93; 347/92
(58) Field of Search ..... 347/86, 84, 85, 347/93, 94, 92

(56) References Cited

U.S. PATENT DOCUMENTS 6,270,205 B1 * 8/2001 Takata ..... 347/85
2001/0030676 A1 * 10/2001 Owaki et al. ..... 347/93

FOREIGN PATENT DOCUMENTS

JP 2001-71525 * 3/2001 ..... B41J/2/175

* cited by examiner

*Primary Examiner*—Huan Tran
(74) *Attorney, Agent, or Firm*—Oliff & Berridge, PLC

(57) ABSTRACT

Ink supplied from an ink source to a filter is guided from a tangential direction with respect to the filter. In addition, a partition wall having a spiral shape reduces the cross-sectional area of an ink passage on the upper surface of the filter and produces a rapid ink flow on the upstream side of the filter. The ink flows from the periphery of the filter to the center of the filter. This ink flow allows air bubbles in the ink to be forced to pass through openings of the filter, thereby being discharged to the exterior of the device. Accordingly, faulty ink supply, due to clogging of the filter with air bubbles, is prevented.

15 Claims, 7 Drawing Sheets

INK-JET RECORDING APPARATUS

BACKGROUND OF THE INVENTION

1. Field of Invention

The invention relates to an ink-jet recording apparatus that ejects ink to record on a recording medium.

2. Description of Related Art

Ink-jet recording apparatuses are typically provided with actuators formed by piezoelectric elements or heating elements, and eject ink selectively by deforming the piezoelectric elements or by locally heating ink to a boil using the heating elements. Ink is supplied, via a tube or directly from an ink cartridge, to a plurality of actuators through an ink passage. A filter is typically provided in the ink passage to remove foreign matter and air bubbles from the ink flowing into the actuators.

Occasionally, in such ink-jet recording apparatuses, a number of actuators are simultaneously driven to eject ink, or ink is sucked while a number of nozzles are covered with a cap to perform a recovery operation. In such cases, the ink passage should have a cross-sectional area appropriate for supplying a large amount of ink to the actuators.

A filter typically has very small openings in its lattice frame. Ink is supplied through the filter to the actuators. Thus, the total area of the openings of the filter should be large enough to allow a large amount of ink to be supplied at any given time. The total area of the openings should be larger than the cross-sectional area of the ink passage.

Recently, high-resolution and multilevel gray-scale printing has become popular. As the demand for this printing grows, a number of actuators are arranged in a single head, and the diameter of each nozzle is made to be extremely small. In some cases, a plurality of ink droplets are continuously ejected to form a dot. Further reducing the size of openings of the filter is advantageous to remove smaller foreign matter and air bubbles, while further increasing the total area of the openings of the filter is advantageous to allow a larger amount of ink to be supplied at any given time. To achieve these advantages, the ink passage should be enlarged on the upstream and downstream sides of the filter.

By increasing the velocity of flow of ink passing through the filter in a structure wherein ink is sucked with a number of nozzles that are covered with a cap, when ink is forcibly ejected under high pressure applied from an ink source side, or when all actuators are simultaneously driven to perform flushing (hereinafter, these operations are generically referred to as "recovery operations"), air bubbles are forced to pass through the filter and are discharged through the nozzle.

However, when the total area of the filter is large, the velocity of flow of ink is reduced on the upstream side of the filter, resulting in a deposition of air bubbles generated in the ink on the upstream side of the filter. Air bubbles deposited on the filter reduce the effective area of the filter. As a result, ink supply becomes insufficient, and faulty ink ejection is caused when a number of actuators are simultaneously driven or when actuators are continuously driven to perform printing.

SUMMARY OF THE INVENTION

According to the invention, air bubbles on the upstream side of a filter are effectively discharged, and excellent ink ejection can be maintained for a long time.

In the invention, a partition member is provided to define a path of ink passing through a filter.

In this configuration, the path of ink passing through the filter can be narrowed, and thus the velocity of flow of ink can be increased when recovery operations are performed as described above, or when a number of actuators are simultaneously driven. Consequently, air bubbles in the ink are deformed to easily pass through the filter. Then, air bubbles are discharged through the actuators to the exterior of the device. Accordingly, faulty ink supply due to air bubbles is prevented, and excellent ink ejection can be maintained for a long time.

The partition member preferably includes a rib extending parallel to the filter. Ink is guided along the rib. Even a partition member that has a complex shape can be easily molded from a resin. Further, a peripheral wall may be provided so as to enclose the periphery of the filter. The peripheral wall and the partition member cooperate to guide the ink, through the effective use of the entire surface of the filter, and produce an ink flow effectively passing over the entire surface thereof.

When the partition member is configured so as to be appropriately spaced from the peripheral wall, a rapid ink flow is effectively produced and guided in a circumferential direction of the filter. Further, when the partition member is configured so as to extend in a spiral manner, the ink is guided to turn from the periphery to the center of the filter or from the center to the periphery thereof. Accordingly, a rapid ink flow is effectively produced over the entire surface of the filter.

The partition wall may include two parallel ribs extending substantially from the center of the filter toward a direction approaching the peripheral wall. In this configuration, ink supplied to the center of the filter is guided along the peripheral wall, or ink supplied to the peripheral wall side is guided to the center of the filter. Thus, an ink flow is effectively produced over the entire surface of the filter.

When the partition member includes a plurality of ribs disposed parallel to each other and each rib is spaced, at at least one of its ends, from the peripheral wall, the ink is guided along the ribs in a zigzag manner. Accordingly, an ink flow can be effectively produced over the entire surface of the filter.

It is more preferable that a guideway is provided so as to supply the ink in a direction parallel to the filter surface. Such a guideway allows the ink to be supplied over a wider area of the filter and an ink flow can be effectively produced along the filter surface. In this case, the guideway may have a curved surface that redirects the ink gradually from a direction intersecting the filter surface to a direction parallel thereto. Even when the ink passage above the filter extends substantially perpendicularly to the filter surface, the ink flow is redirected by the guideway immediately before the ink is supplied to the filter and, as a result, the ink flows along the filter surface. Accordingly, the ink is supplied over a wider area of the filter without being concentrated into a certain portion thereof.

When the guideway extends parallel to the filter surface, the ink flows along the filter surface to be supplied over a wider area of the filter. Further, when the guideway extends parallel to a tangent to the periphery of the filter, a rapid ink flow is produced that passes along the periphery of the filter and along the filter surface.

In this configuration, a rapid ink flow is produced to pass in a spiral manner from the periphery to the center of the filter. Consequently, air bubbles in the ink are deformed to pass through the filter, and then are discharged to the exterior of the device.

The peripheral wall that encloses the filter may be formed to be round, continuous and integral with a part of a wall defining the guideway. When the width of the guideway is less than the radius of the peripheral wall, the velocity of flow of ink in the guideway is increased. Thus, the ink flows more effectively and rapidly in a spiral manner.

Further, the ink passage maybe a space defined by joining two members, which extend parallel to a direction of flow of ink, so as to face each other. A port connected to the recording head is integrally formed with one of the two members and covered with the filter, and the partition member is formed integrally with the other of the two members. When the two members are joined to each other, the partition member comes into contact with, or alternatively is disposed close to but not in contact with, the filter. By simply joining the two members so as to sandwich the filter, the ink passage and the partition member can be easily formed.

BRIEF DESCRIPTION OF THE DRAWINGS

Preferred embodiments of the invention will be described with reference to the following figures wherein.

DETAILED DESCRIPTION OF PREFERRED EMBODIMENTS

Figure 8:
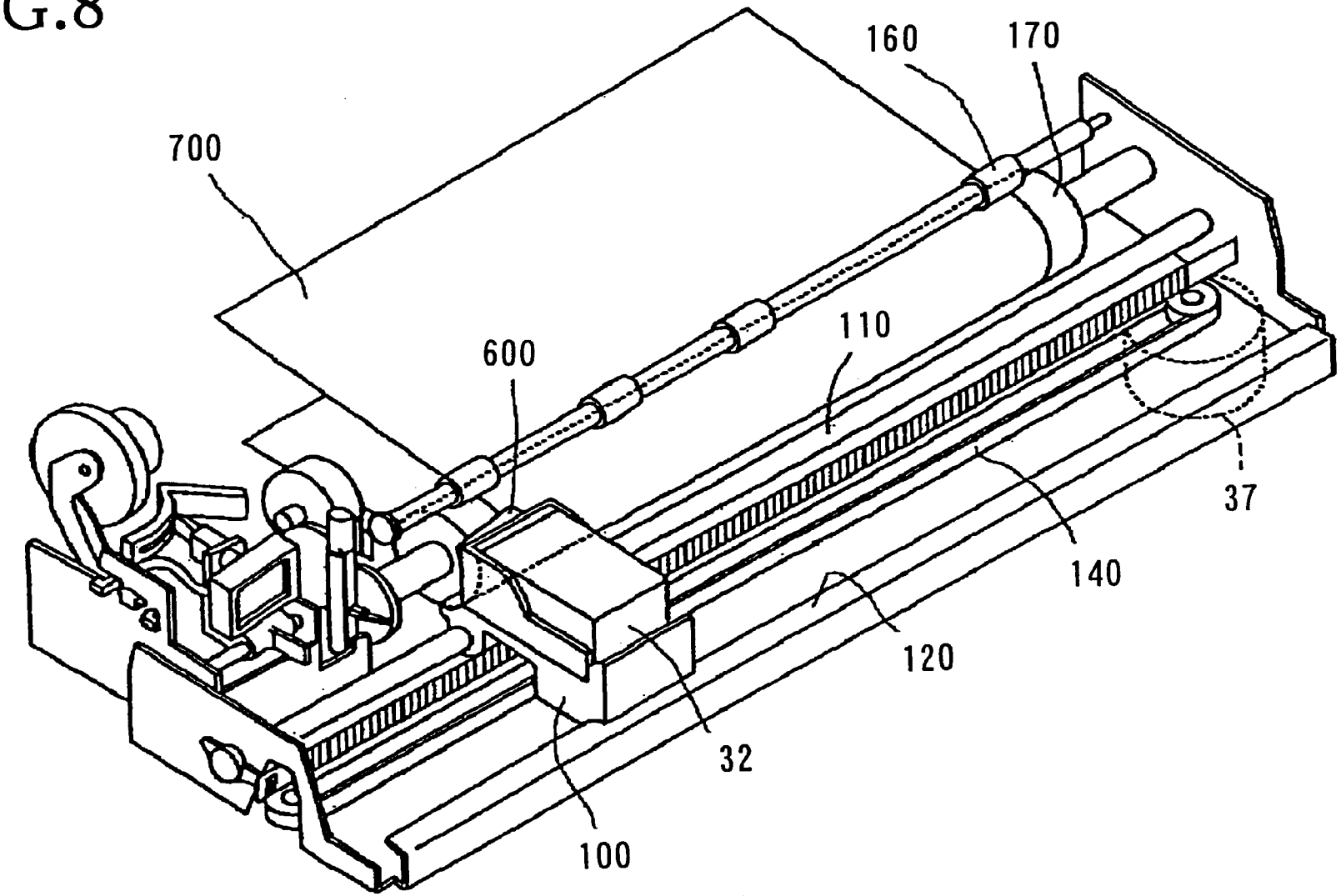
FIG. 8 is a perspective view of an ink-jet printer.

FIG. 8 shows major components of an ink-jet printer.

As shown in FIG. 8, an ink-jet head unit 600 is mounted on a carriage 100 and is scanned parallel to a recording medium 700. The carriage 100 is slidably supported by guide bars 110, 120. The carriage is also fixed to a belt 140 extending parallel to the guide bars 110, 120. The belt 140 is moved by a driving force of a motor 37. As the belt 140 is moved, the carriage 100 reciprocates along the guide bars 110, 120. An ink cartridge 32 containing ink to be supplied to the head unit 600 is removably attached to the carriage 100. The recording medium 700 is held by feed rollers 160, 170 parallel to the scanning direction of the head unit 600 and is fed perpendicularly to the scanning direction.

Figure 1:
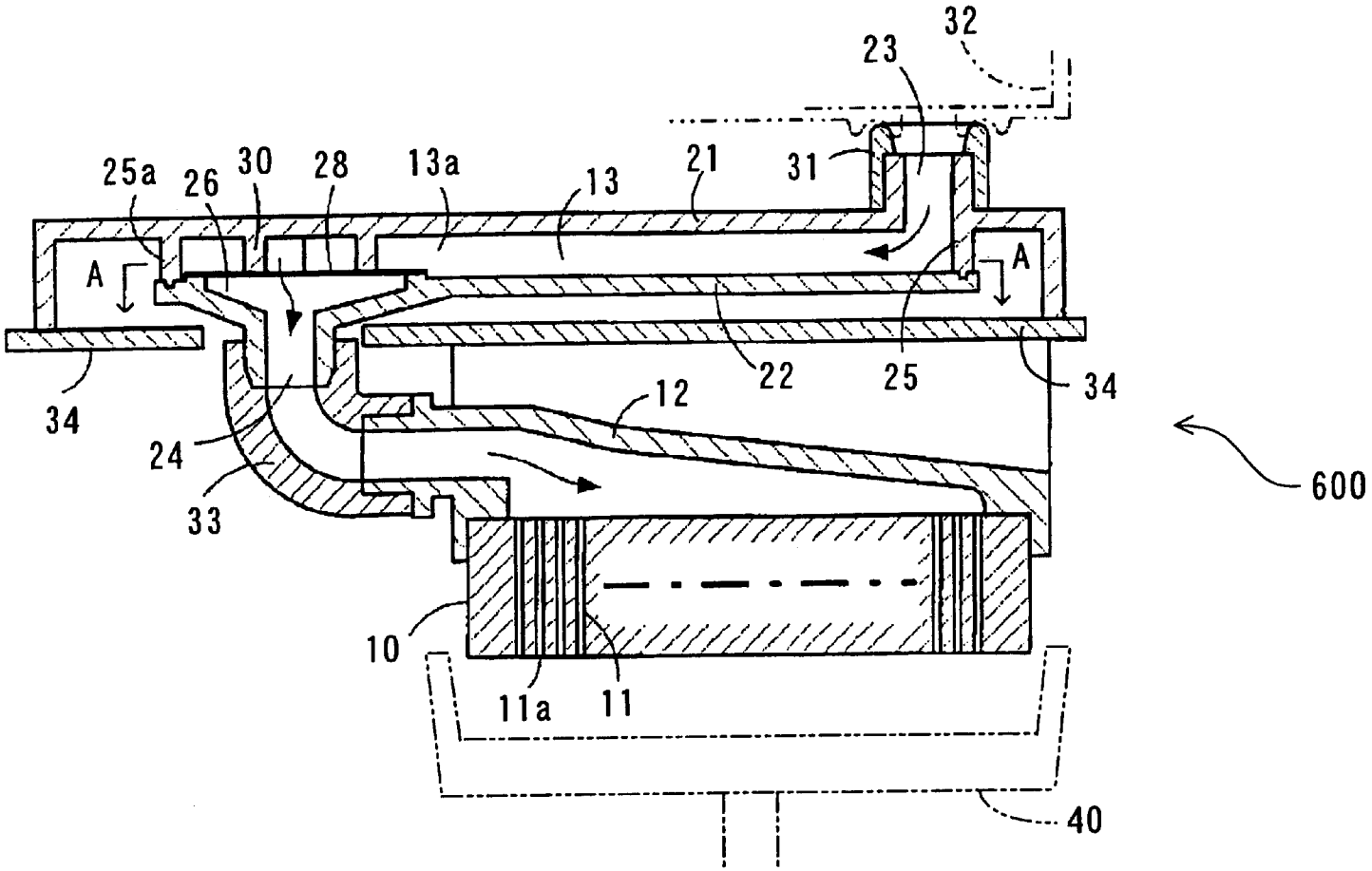
FIG. 1 is a sectional view of a substantial part of an ink-jet printer, according to an embodiment of the invention, taken along plane B—B of FIG. 2.

As shown in FIG. 1, a recording head 10, as the head unit 600, can be provided with a plurality of actuators having ink channels 11, and ejects ink from nozzles 11*a* formed at lower ends of the ink channels 11. One type of such actuator locally heats ink in the ink channel to a boil to eject ink, and another type has ink channel sidewalls formed by piezoelectric elements, which are deformed, upon the application of a voltage, to eject ink.

A manifold 12 is disposed on the opposite side of the recording head 10 from the nozzles 11*a*. The manifold 12 diverts ink supplied from an ink source to a plurality of ink channels 11. An ink passage 13 interconnecting the manifold 12 and the ink source is formed by two passage-forming members 21, 22.

Figure 3:
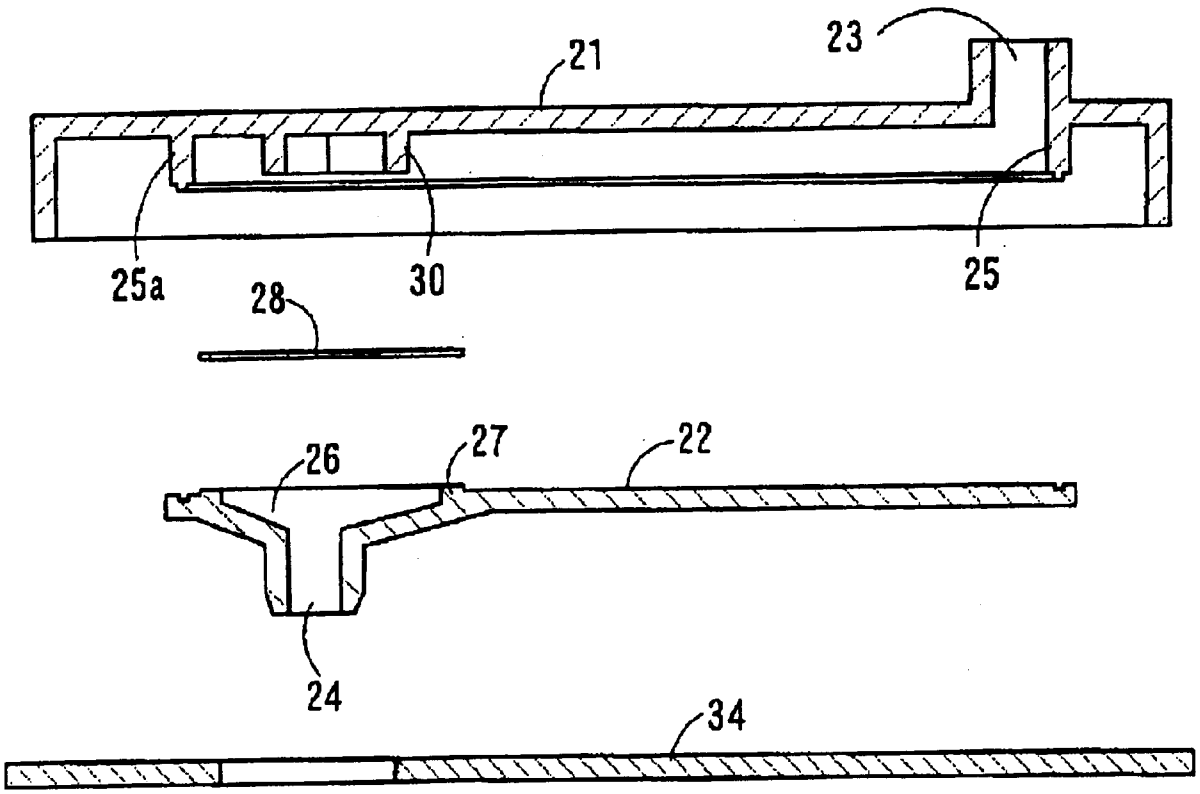
FIG. 3 is a partially exploded view of FIG. 1.

As shown in FIGS. 1 and 3, the ink passage 13 extends along a plane parallel to the direction of an array of a plurality of ink channels 11. The two passage-forming members 21, 22 extend along the direction of flow of ink in the ink passage 13 and are disposed in a direction perpendicular to the flow of ink, that is, in upper and lower positions so as to face each other.

The upper passage-forming member 21 is provided, on its upper side, with a connecting port 23 that is connected to one end of the ink passage 13 and extends upward in a tubular shape. The upper passage-forming member 21 is provided, on its lower side, with a rib-like peripheral wall 25 that extends downward so as to enclose a periphery of the ink passage 13. The lower passage-forming member 22 is provided, on its lower side, with a connecting port 24 that is connected to the other end of the ink passage 13 and extends downward in a tubular shape. The passage-forming members 21, 22 are molded from a synthetic resin. The lower passage-forming member 22 abuts the lower end of the rib-like peripheral wall 25 and they are ultrasonically joined to each other.

A portion surrounding the connecting port 24 of the lower passage-forming member 22 is recessed like a funnel, and is tapered from top to bottom. A filter 28 is thermally fixed to a peripheral wall 27 at the upper end of a recess 26 so as to cover the recess 26. The filer 28 is formed from meshed or sintered metal fibers, and its outer shape is preferably round. The opening area at the upper end of the recess 26 is determined such that the total area of openings of the filter 28 is equal to or larger than the total cross-sectional area of a plurality of ink channels 11. Areas of portions where the filter 28 makes contact with a rib-like partition wall 30, to be described later, and with the peripheral wall 27, are excluded.

Figure 2:
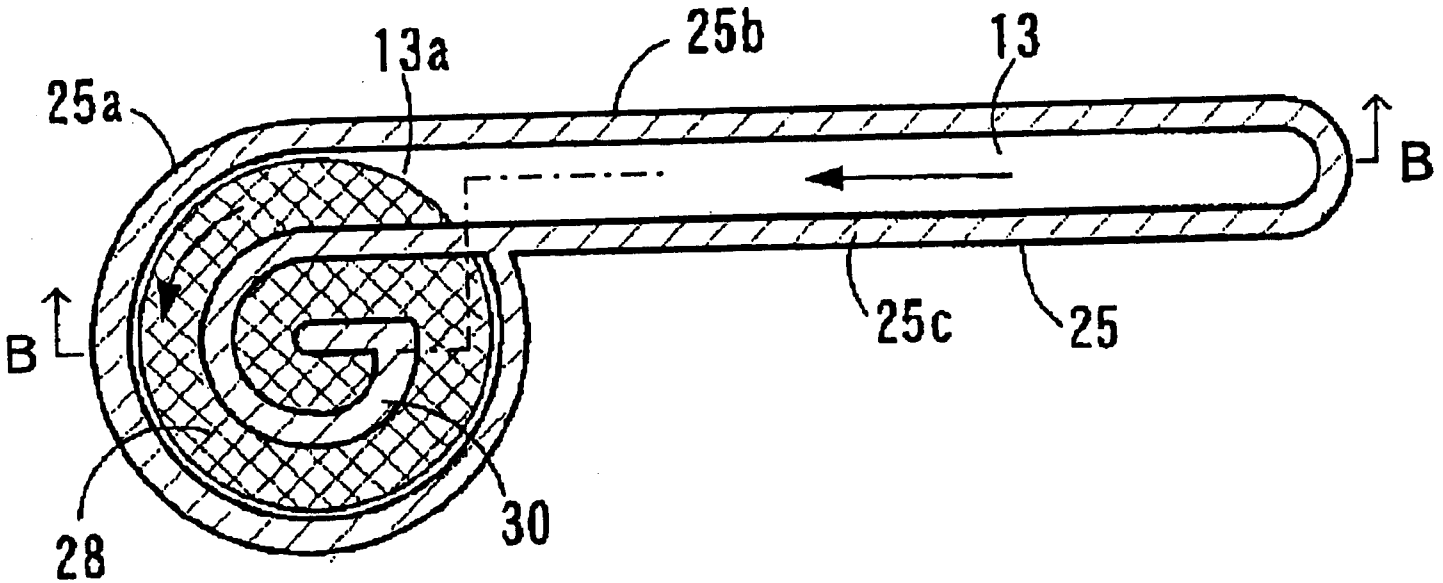
FIG. 2 is a sectional view taken along plane A—A of FIG. 1.

As shown in FIG. 2, a peripheral wall section 25*a* of the peripheral wall 25 is round in shape so as to enclose the filter 28. The width between peripheral wall sections 25*b*, 25*c*, which enclose a linear portion of the ink passage 13 interconnecting the peripheral wall section 25*a* and the connecting port 23, is less than the radius of the peripheral wall section 25*a*. The linear peripheral wall section 25*b* extends tangentially from the round peripheral wall section 25*a*. Thus, a guideway 13*a*, which connects the ink passage 13 extending from the connecting port 23 to the round peripheral wall section 25*a*, is parallel to the upper surface of the filter 28 and is tangentially connected to the periphery of the filter 28.

The filter 28 is partitioned, on its upper surface (on the ink supplying side), by a rib-like partition wall 30 extending along the upper surface. The partition wall 30 integrally projects from the lower surface of the upper passage-forming member 21 so as to come into contact with, or alternatively to be disposed close to but not in contact with, the upper surface of the filter 28. The partition wall 30 extends from the other peripheral wall section 25*c*, which encloses the linear portion of the ink passage 13, to the filter 28, and further extends to the center of the filter 28 in a spiral manner, so as to be spaced from the round peripheral wall section 25*a*. In cooperation with the peripheral wall section 25*a*, the partition wall 30 partitions a space above the filter 28 in a spiral manner. Consequently, an elongated space extending from the periphery to the center of the filter 28 is formed, and the cross-sectional area of the filter 28, which is perpendicular to the ink flow direction, is reduced compared with the case where no partition wall 30 is provided.

The connecting port 23 of the upper passage-forming member 21 is provided with a seal 31 so as to receive an ink cartridge 32 containing ink. Alternatively, an ink tank can be connected to the connecting port 23 through a tube (not shown). The connecting port 24 of the lower passage-forming member 22 is connected to the manifold 12 through a tube 33.

The passage-forming members 21, 22, recording head 10, and manifold 12 are secured to a support plate 34 and integrated into a single unit.

An ink sucking operation can be performed in an ink-jet printer to remove air bubbles and foreign matter. During the ink sucking operation, a pump connected to a cap 40 is driven while all nozzles 11*a* are covered with the cap 40. When the pump is driven, ink is drawn from the ink cartridge 32 into the ink passage 13 and the manifold 12. When the ink flows from the guideway 13*a* onto the filter 28, the partition wall 30 makes the ink rapidly turn along the periphery of the filter 28 and flow into the center of the filter 28. In other words, the ink passes through the filter while it flows rapidly over the entire surface of the filter 28. Such ink flow allows air bubbles generated in the ink, even if they are larger than the very small openings of the filter 28, to deform and pass through the very small openings. Air bubbles having passed through the filter 28 are discharged together with the ink from the nozzles 11*a* through the manifold 12 and the ink channels 11.

By performing the sucking operation, air bubbles contained in the ink in the ink channel 13 can be effectively discharged. This prevents the openings of the filter 28 from being clogged with air bubbles over a long period. Accordingly, when a number of actuators are simultaneously driven, ink is sufficiently supplied to the ink channels 11 and excellent ink ejection can be maintained.

In addition to the above-described sucking operation, other operations can be performed to discharge air bubbles and foreign matter. Ink is ejected under high pressure applied from the ink source side, or ink is forcibly ejected through a flushing operation by simultaneously driving all actuators. When these operations are performed, ink flowing from the guideway 13*a* onto the filter 28 turns rapidly along the periphery of the filter 28 toward the center thereof, in the same manner as described above. Accordingly, air bubbles contained in the ink are deformed by such ink flow and pass through the openings of the filter 28.

Figure 4:
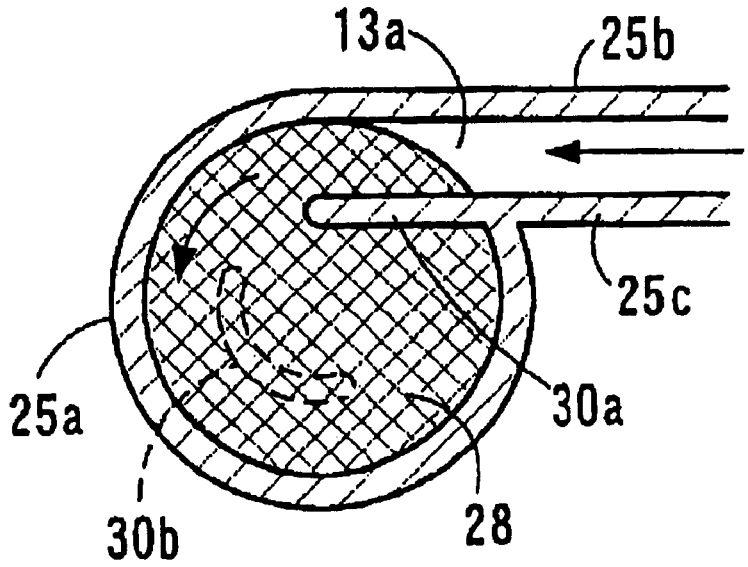
FIG. 4 is a sectional view of a substantial part according to another embodiment of the invention.

Although the partition wall 30 is formed into a spiral shape in the above-described embodiment, a partition wall 30*a* may be formed so as to extend from the linear peripheral wall section 25*c*, as shown in FIG. 4. Alternatively, a partition wall 30*b* may be provided away from the linear peripheral wall section 25*c* in the circumferential direction, so as to be spaced from and concentrically with the peripheral wall section 25*a*. Alternatively, both of these partition walls 30*a*, 30*b* may be provided. In these configurations, ink also flows from the guideway 13*a* parallel to the surface of the filter 28, tangentially toward the periphery of the filter 28, and turns along the periphery of the filter 28 as a rapid ink flow.

Figure 5:
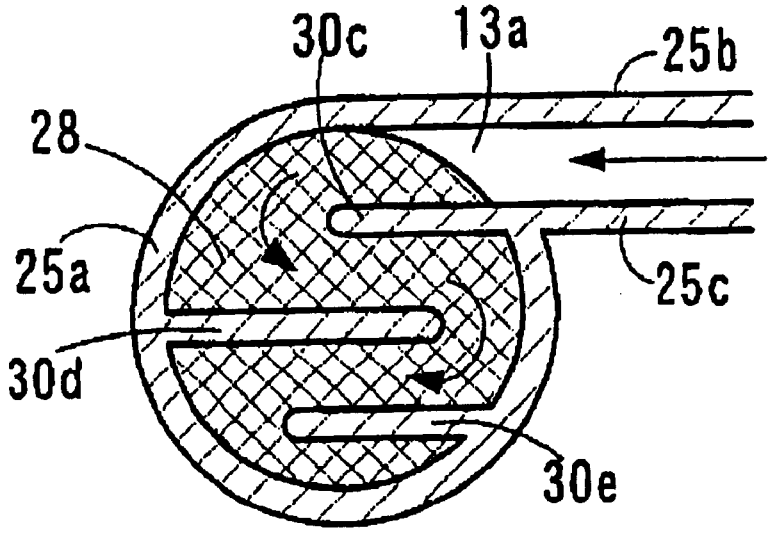
FIG. 5 is a sectional view of a substantial part according to another embodiment of the invention.

FIG. 5 shows another embodiment of the invention. A plurality of rib-like partition walls 30*c*, 30*d*, 30*e* are provided so as to be parallel with each other. The partition wall 30*c* extends from the linear peripheral wall section 25*c* and its end is spaced from the round peripheral wall section 25*a*. The partition wall 30*d* is integrally connected to one point of the round peripheral wall section 25*a* and extends parallel to the partition wall 30*c*, and its end is directed toward another point of the round peripheral wall section 25*a*, and is spaced a certain distance from the round peripheral wall section 25*a*. Also, the partition wall 30*e* is integrally connected to one point of the round peripheral wall section 25*a* and extends parallel to the partition wall 30*c*, and its end is directed toward another point of the round peripheral wall section 25*a* and is spaced a certain distance from the round peripheral wall section 25*a*. The partition walls 30*c*, 30*d*, 30*e* can alternately extend in the opposite direction from the peripheral wall section 25*a*.

Specifically, the partition walls 30*c*, 30*d*, 30*e* are formed such that ink flows windingly, in a staggered manner, along the upper surface of the filter 28. In this configuration, the cross-sectional area of the ink passage is reduced, and the velocity of ink flow passing through the filter 28 is increased, thereby enhancing the ability to eliminate air bubbles.

Figure 6A:
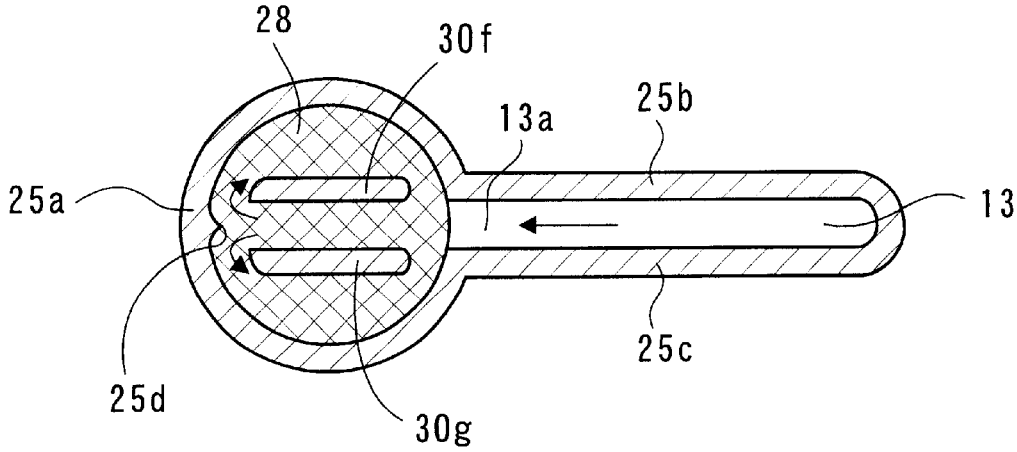
FIGS. 6A and 6B are sectional views of substantial parts according to other embodiments of the invention.

FIG. 6A shows still another embodiment of the invention. As shown in FIG. 6A, two substantially parallel rib-like partition walls 30*f*, 30*g* are integrally formed with a passage-forming member 21 Peripheral wall sections 25*b* and 25*c* are disposed such that the center of an ink passage 13, which is defined by the peripheral wall sections 25*b* and 25*c*, are aligned with the center of a filter 28. The partition walls 31*f*, 30*g* are disposed so as to be aligned with peripheral walls sections 25*b*, 25*c*, respectively, and spaced from a peripheral wall section 25*a*. As a guideway 13*a* is directed toward the center of the filter 28, ink flowing from the guideway 13*a* passes between the partition walls 30*f*, 30*g* and strikes the peripheral wall section 25*a*. Then, the ink is diverted outwardly to two directions and flows along the peripheral wall section 25*a*. A triangular protrusion 25*d* is formed, at a portion of the peripheral wall section 25*a* opposed to the guideway 13*a*, so as to divert the ink flow to two directions. By the aid of the protrusion 25*d*, the ink flowing from the guideway 13*a* is easily divided so as to flow in two directions.

In this configuration also, the cross-sectional area of the ink passage is reduced and the velocity of ink flow passing through the filter 28 is increased, thereby enhancing the ability to eliminate air bubbles.

Figure 6B:
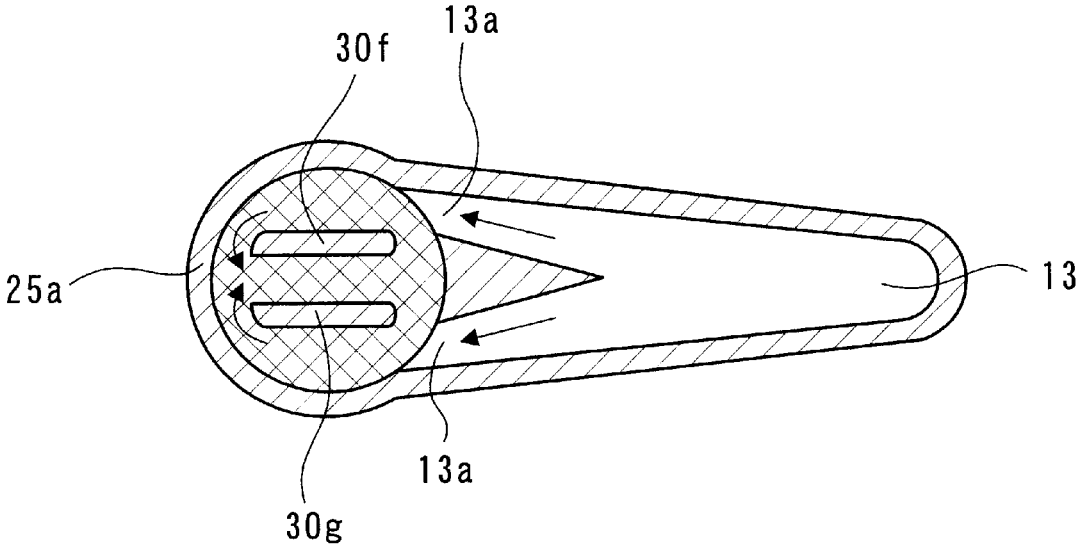

Although, in the embodiment shown in FIG. 6A, ink is guided to flow from the guideway 13*a* to a passage between the partition walls 30*f*, 30*g*, an alternative configuration is conceivable. As shown in FIG. 6B, each guideway 13*a* may be connected to a portion between a partition wall 30*f* and a peripheral wall section 25*a*, and a portion between a partition wall 30*g* and the peripheral wall section 25*a* so as to allow the ink flowing from a connecting port 23 to be supplied to a filter 28 through two passages. In this configuration, the ink flows along the peripheral wall section 25*a* and is guided to a passage between the partition walls 30*f*, 30*g*.

Figure 7:
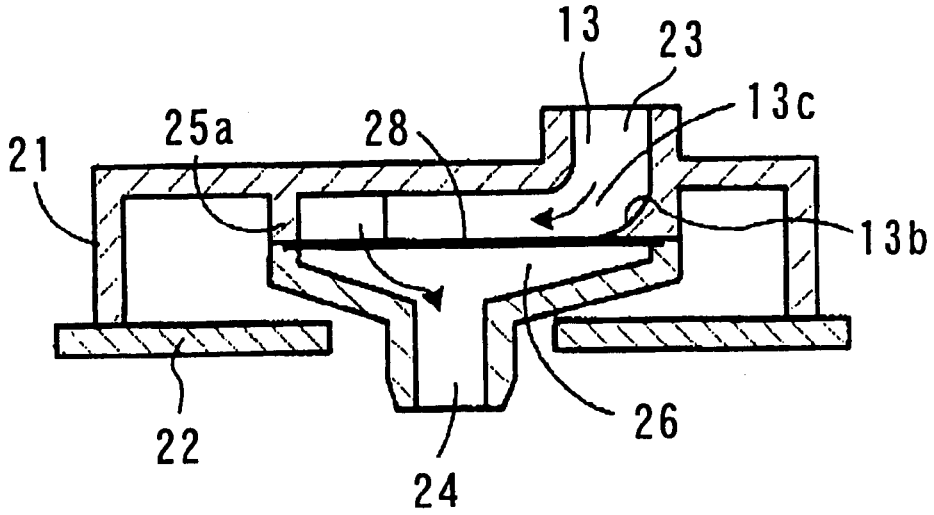
FIG. 7 is a sectional view of a substantial part of another embodiment of the invention.

FIG. 7 shows still another embodiment of the invention.

A connecting port 23 of an upper passage-forming member 21 is formed so as to face a filter 28. The direction of ink flow in an ink passage 13 is perpendicular to the filter 28. In the vicinity of the filter 28, a curved surface 13*b* is formed at the passage-forming member 21. The curved surface 13*b* directs a guideway 13*c* to a direction parallel to the surface of the filter 28, along which ink flows. Ink supplied from a connecting port 23 flows perpendicularly to the surface of the filter 28, and then the ink is redirected by the curved surface 13*b* and supplied onto the filter 28.

Accordingly, the ink is supplied over the entire surface of the filter 28 without being concentrated into a certain portion thereof, and flows along the surface of the filter 28.

The guideway 13*c* configured as described above can be applied to any one of the embodiments described above with reference to FIGS. 2, 4, 5, and 6A. In the configurations shown in FIGS. 2 and 4, if a guideway 13*c* is disposed at the center of the filter 28, ink flows from the center of the spiral passage to the periphery of the filter 28.

Further, in each of the above-described embodiments, an additional wall, identical or similar to in shape, to a partition wall can be provided at a recess 26 opposed to the partition wall such that a filter is sandwiched by the additional wall and the partition wall.

What is claimed is:

1. An ink-jet recording apparatus, comprising:

an ink source;

a recording head that ejects ink;

an ink passage that supplies the ink from the ink source to the recording head;

a filter provided in the ink passage, the filter having a side that faces the ink source; and a partition member disposed at the side of the filter that faces the ink source so as to define an ink path along which the ink passes through the filter.

2. The ink-jet recording apparatus according to claim 1, wherein the partition member includes a rib extending perpendicular to the filter.

3. The inkjet recording apparatus according to claim 1, further including a peripheral wall that encloses a periphery of the filter.

4. The ink-jet recording apparatus according to claim 3, wherein the partition member is spacedly from and extends concentrically with the peripheral wall so as to guide the ink in a circumferential direction of the filter.

5. The ink-jet recording apparatus according to claim 4, wherein the partition wall extends in a spiral manner so as to guide the ink to turn from the periphery of the filter to a center of the filter or from the center of the filter to the periphery of the filter.

6. The ink-jet recording apparatus according to claim 3, wherein the partition member includes two parallel ribs extending substantially from the center of the filter toward a direction approaching the peripheral wall of the filter.

7. The ink-jet recording apparatus according to claim 3, wherein the partition member includes a plurality of ribs disposed parallel to each other, and at least one end of each of the plurality of ribs is spaced from the peripheral wall of the filter such that the ink is guided by the peripheral wall of the filter and the plurality of ribs to flow in a zigzag manner and pass through the filter.

8. The ink-jet recording apparatus according to claim 1, further including a guideway formed at the ink passage so as to guide the ink in a direction parallel to a surface of the filter.

9. The ink-jet recording apparatus according to claim 8, wherein the guideway has a curved surface that redirects the ink gradually from a direction intersecting the surface of the filter to a direction parallel thereto.

10. The ink-jet recording apparatus according to claim 8, wherein the guideway extends parallel to the surface of the filter.

11. The ink-jet recording apparatus according to claim 10, wherein the guideway extends parallel to a tangent to the periphery of the filter.

12. The ink-jet recording apparatus according to claim 1, wherein the ink passage is a space defined by joining two members, which extend parallel to a direction of flow of the ink, so as to face each other, a port connected to the recording head is integrally formed with one of the two members and is covered with the filter, the partition member is formed integrally with the other of the two members, and the partition member has a disposition of one of being in contact with the filter and being adjacent to and not in contact with the filter when the two members are joined to each other.

13. An ink-jet recording apparatus, comprising:

an ink source;

a recording head that ejects ink;

an ink passage that supplies the ink from the ink source to the recording head; and a filter provided in the ink passage, the filter having a periphery and an upstream side;

wherein the ink passage has, at the upstream side of the filter, a guideway extending parallel to a tangent to the periphery of the filter.

14. The ink-jet recording apparatus according to claim 13, further including a substantially round peripheral wall that encloses the filter, the peripheral wall being formed continuously and integrally with a part of a wall defining the guideway, wherein a width of the guideway is less than a radius of the peripheral wall.

15. The ink-jet recording apparatus according to claim 13, wherein the ink passage is a space defined by joining two members, which extend parallel to a direction of flow of the ink, so as to face each other, a port connected to the recording head is integrally formed with one of the two members and is covered with the filter, the partition member is formed integrally with the other of the two members, and the partition member has a disposition of one of being in contact with the filter and being adjacent to and not in contact with the filter when the two members are joined to each other.

* * * * *